United States Patent [19]

Vizmeg

[11] 3,938,936

[45] Feb. 17, 1976

[54] FLUID CONTROL SYSTEM

[75] Inventor: George Vizmeg, West Covina, Calif.

[73] Assignee: Carrier Corporation, Syracuse, N.Y.

[22] Filed: Sept. 5, 1974

[21] Appl. No.: 503,554

[52] U.S. Cl. ..... 431/51; 431/47; 431/54; 137/65; 431/43

[51] Int. Cl.[2] ..... F23Q 9/08

[58] Field of Search ..... 431/43, 47, 51, 54, 56; 137/65, 66

[56] References Cited

UNITED STATES PATENTS

| | | | |
|---|---|---|---|
| 2,564,863 | 8/1951 | Strobel | 431/43 |
| 2,881,830 | 4/1959 | Leins | 431/47 |
| 2,903,053 | 9/1959 | Kile | 431/47 |
| 3,191,661 | 6/1965 | Ray | 431/43 |
| 3,240,257 | 3/1966 | Ray | 431/43 |
| 3,501,253 | 3/1970 | Wade | 431/43 |
| 3,519,376 | 7/1970 | Dietz | 431/43 |

*Primary Examiner*—John J. Camby
*Assistant Examiner*—Henry C. Yuen
*Attorney, Agent, or Firm*—J. Raymond Curtin; Barry E. Deutsch

[57] ABSTRACT

A fluid control system for use with combustion apparatus including a valve assembly having first and second serially connected valves positioned between the inlet and outlet of the valve assembly. First and second actuators respectively connected to operate the first and second valves function to maintain each of the valves in closed positions in the absence of a flame at the pilot burner of the combustion apparatus to prevent flow of fluid to the main burner.

2 Claims, 4 Drawing Figures

FLUID CONTROL SYSTEM

BACKGROUND OF THE INVENTION

The present invention relates to fluid control systems for use with combustion apparatus, and in particular to such a system for controlling the safe burning of gas at the main burner.

As is well recognized, it is imperative that a fluid control system employed to control the flow of fuel to combustion apparatus operate immediately to stop the flow of fuel to the main burner if the pilot burner is inoperative.

Heretofore, most fuel control systems have included safety valves, generally operated by a thermo-couple provided to sense heat produced as a result of combustion of fuel at the pilot burner. If a pilot outage were to occur, the thermo-couple reacts to the reduction in generated heat to place the safety valve in a closed position to discontinue or prevent flow of gas to the main burner.

An example of the prior art is illustrated in U.S. Pat. No. 3,240,257. In the cited patent the illustrated control system includes a valve having two serially connected valves mounted within a common housing. One of the valves is responsive to a thermostat provided to sense demands for heat in a space served by the combustion apparatus and the other valve is responsive to the thermo-couple associated with the pilot burner. If the safety valve disclosed in the prior art patents fails to function as required, and fails in an open position, there is no backup capability in the control system to prevent continued flow of raw gas to the main burner. Thus, when the thermostat senses that heat is required in the space, the valve responsive thereto will open, even though the gas will not be ignited due to the inoperability of the pilot burner.

The present invention contemplates a single valve assembly for use in a fluid control system that includes at least two valves, each of which function independently to prevent the flow of gas to a main burner if the pilot burner is inoperative. The single valve assembly may be readily and economically installed in control systems serving combustion apparatus already in commercial use.

SUMMARY OF THE INVENTION

Accordingly, it is a general object of the present invention to provide a fluid control system including backup safety means to discontinue or prevent the flow of fuel to a main burner when the pilot burner is not operable.

It is a further object of this invention to provide a fluid control system providing an automatic interlocked sequence of events to allow gas to flow to the main burner of a combustion apparatus and to prevent the gas from so flowing if the pilot burner is inoperable.

It is a further object of this invention to eliminate the need to hold a manual push button pilot valve in a depressed state when manually lighting a pilot burner.

These and other objects of the present invention are obtained by providing a fluid control system for use with combustion apparatus including a valve assembly having first and second serially related valves positioned between the inlet and the outlet of the valve assembly. The system further includes a main burner and a pilot burner. A first actuator is provided for selectively operating the first valve. The actuator includes means to open the valve to permit passage of fluid from a first portion of the valve to a second portion thereof, the actuator maintaining the first valve closed in the absence of a flame at the pilot burner. The system further includes a second actuator for selectively operating the second valve including means to open said second valve in response to a demand for heating in the space served by the combustion apparatus. The second actuator further includes means to maintain the second valve closed in the absence of flame at the pilot burner.

DESCRIPTION OF THE PREFERRED EMBODIMENTS

Figure 1:
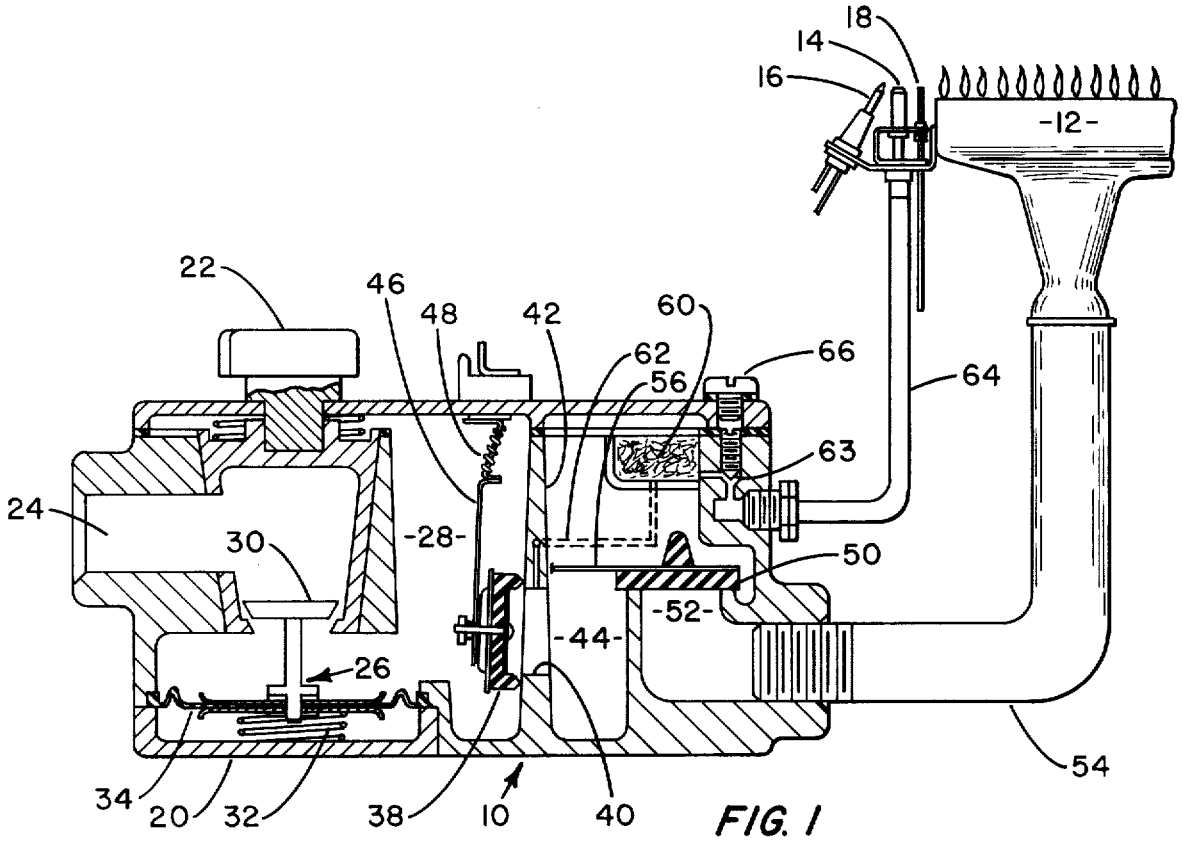
FIG. 1 is a sectional, partially schematic view of a control system in accordance with the invention.
Figure 2:
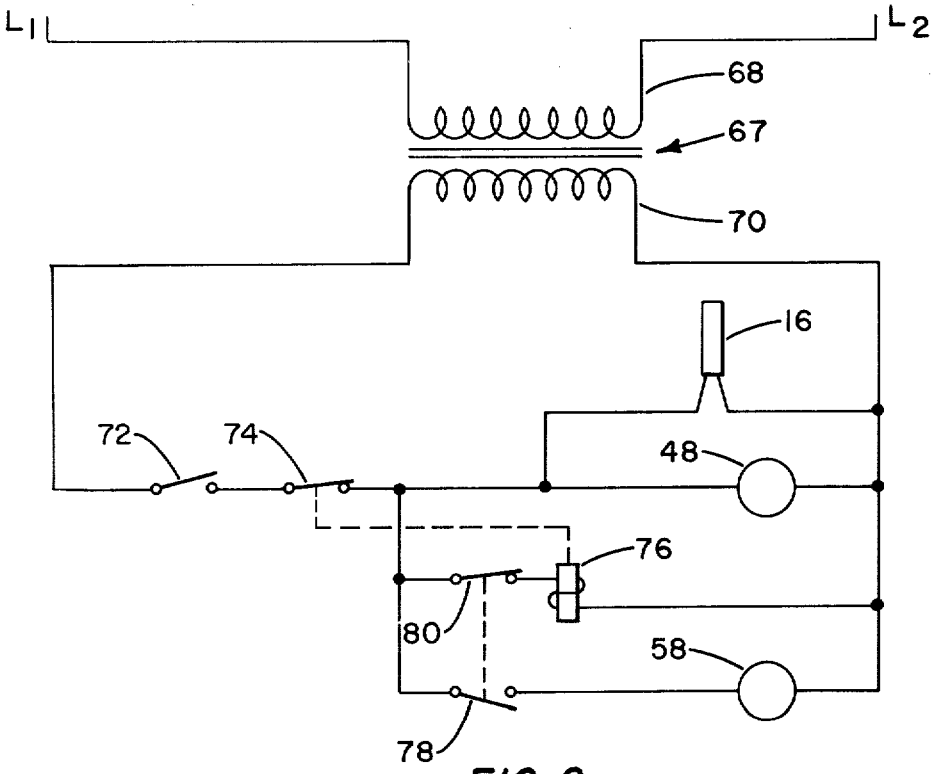
FIG. 2 is a schematic view of an electrical circuit suitable for use with the control system of FIG. 1.

Referring now to the drawings and in particular to FIGS. 1 and 2, there is shown a first preferred embodiment of the instant invention.

A control system includes a valve assembly 10 disposed "upstream" from a main burner 12 and a pilot burner 14. Valve assembly 10 is provided to control the flow of a combustible fluid, for example gas, to the main and pilot burners. A spark ignitor 16 is provided adjacent pilot burner 14. A thermo-couple 18 is provided in proximity to the pilot burner. The thermo-couple functions to generate a signal to indicate that the pilot burner is operating; the absence of the signal indicating that no flame is present at the pilot burner.

Valve assembly 10 includes a housing 20. An on-off gas cock 22 (shown in its on position) is provided to control the flow of the fluid from inlet 24 to a regulator assembly 26 and thence into a first chamber 28. As is conventional within the art, regulator assembly includes a valve member 30, a spring 32, and a diaphragm or bellows 34. The regulator assembly is provided to maintain a predetermined "downstream" pressure.

A valve member 38 is positioned to control the flow of the fluid from first chamber 28 through opening 40 in wall 42 and thence into second chamber 44.

Valve member 38 preferably includes a bimetallic member 46 operably connected to a resistance coil 48 for a reason to be more fully explained hereinafter.

A second valve member 50 is positioned between second chamber 44 and the inlet 52 of conduit 54 provided to supply the combustible fluid to main burner 12. Valve member 50 preferably includes a bimetallic member 56 operably connected to a resistance coil 58 (shown in FIG. 2).

A portion of the fluid in second chamber 44 passes through a filter 60 via passages 62 and 63, which communicate with a conduit 64 provided to supply fluid to pilot burner 14. A screw or similar means 66 is provided to regulate the quantity of fluid passing to conduit 64 and thence to the pilot burner. As is readily observed, it is necessary for valve member 38 to be opened for fluid to flow from first chamber 28 to pilot burner 14 and for both valve members 38 and 50 to be open before fluid will flow from first chamber 28 to main burner 12.

Referring now to FIG. 2, there is illustrated a schematic wiring diagram of an electric circuit suitable for use in the control system of the present invention.

The electrical portion of the control system includes a transformer 67 having a primary winding 68 connected to a source of electrical energy represented by lines L1 and L2, and a secondary winding 70. Connected in series with secondary winding 70 is a first switch 72. Switch 72 is responsive to the temperature of the space being served by the combustion apparatus and closes when the temperature of the space falls below a predetermined level. Connected in series with switch 72 is a normally closed switch 74. Switch 74 is operably connected to a relay 76.

Resistance coil 48 of valve member 38 is connected in series with switches 72 and 74. Also connected in series with switches 72 and 74 is resistance coil 58 of valve member 50. Resistance coil 58 is also connected in series with a normally open switch 78. Switch 78 is operably connected to switch 80. Switch 80 is a normally closed switch provided in series with relay 76. Switches 78 and 80 are operably associated with thermo-couple 18. Spark ignitor 16 is connected in series with switches 72 and 74 and in parallel with resistance coil 48.

The operation of the control system heretofore described shall now be explained in detail.

Assume switch 72 closes in response to the temperature in the space being served by the combustion apparatus falls below its predetermined setting. Also assume gas cock 22 is in the position shown in FIG. 1 so as to permit the flow of gas from inlet 24 to first chamber 28. Resistance coil 48 associated with first valve member 38 will be energized as a result of the closing of switch 72 to open valve member 38 by heating bimetallic member 46 connected thereto. The combustible fluid will flow from first chamber 28 through opening 40 in wall 42 and be supplied through passage 62, filter 60, passage 63 and conduit 64 to pilot burner 14. Spark ignitor 16 is also energized by the closing of switch 72 to thereby ignite the gas at the pilot burner.

During this sequence of events, relay coil 76 in series with switch 80 will also be energized. Switch 74 associated with coil 76 will open after a predetermined time interval, for example ten seconds, after energization of coil 76. Switches 78 and 80 are operatively connected to thermo-couple 18. If the pilot burner is properly ignited, switch 80 will open and switch 78 will close. The closure of switch 78 will energize resistance coil 58 associated with bimetallic member 56 of valve member 50 to thereby open the valve member and permit combustible fluid to pass to conduit 54 to main burner 12. The opening of switch 80 will deenergize relay 76 to thereby maintain switch 74 in its normally closed position.

If the pilot burner were to fail to properly ignite, switch 80 will remain in its normally closed position and switch 78 will remain in its normally open position. With switch 80 in its closed position, relay 76 is energized and, after the predetermined interval of time, will open switch 74 to thereby discontinue the flow of current to resistance coil 48 of valve member 38. The interruption of the flow of current thereto will cause bimetallic member 46 of valve member 38 to cool to thereby close the valve. In addition, switch 78 will remain in its normally open position to thereby prevent the energization of resistance coil 58 of valve member 50. Thus, valve member 50 will remain in its closed position to prevent flow of fluid to main burner 12.

The closure of valve 38 prevents gas from continuing to flow from chamber 28 to the passages in communication with pilot burner 14. In addition, gas is prevented from flowing from first chamber 28 to second chamber 44. Furthermore, by maintaining valve 50 closed in the absence of a pilot flame additional safety means is provided to insure that all flow of fluid will be discontinued to the main burner if the pilot burner is inoperative.

Figure 3:
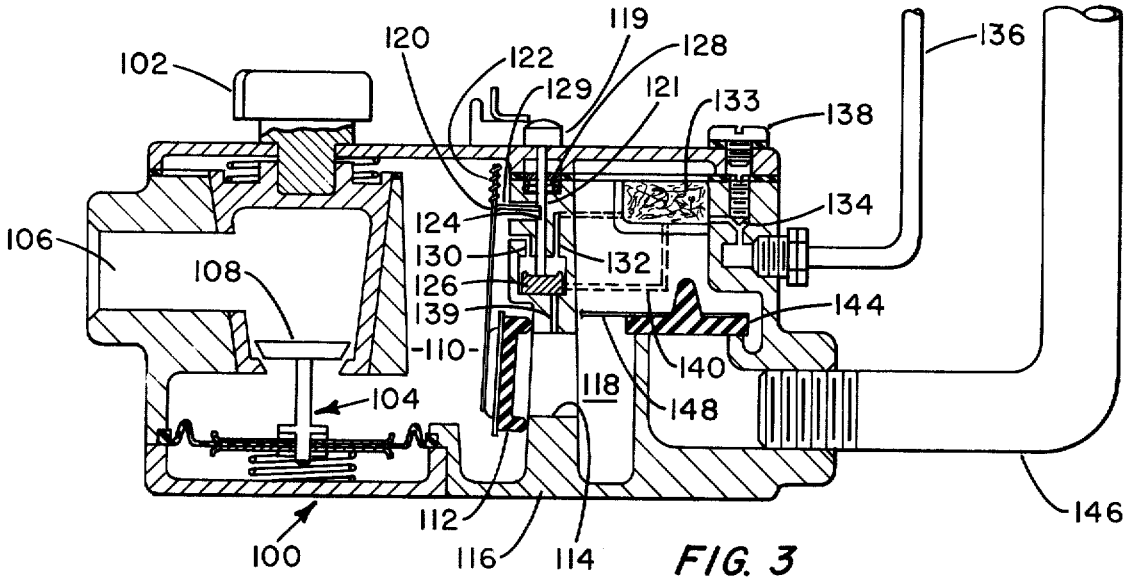
FIG. 3 is a sectional, partially schematic view illustrating an alternative embodiment of the instant invention.

Referring now to FIG. 3, there is disclosed an alternative embodiment of the present invention.

Figure 4:
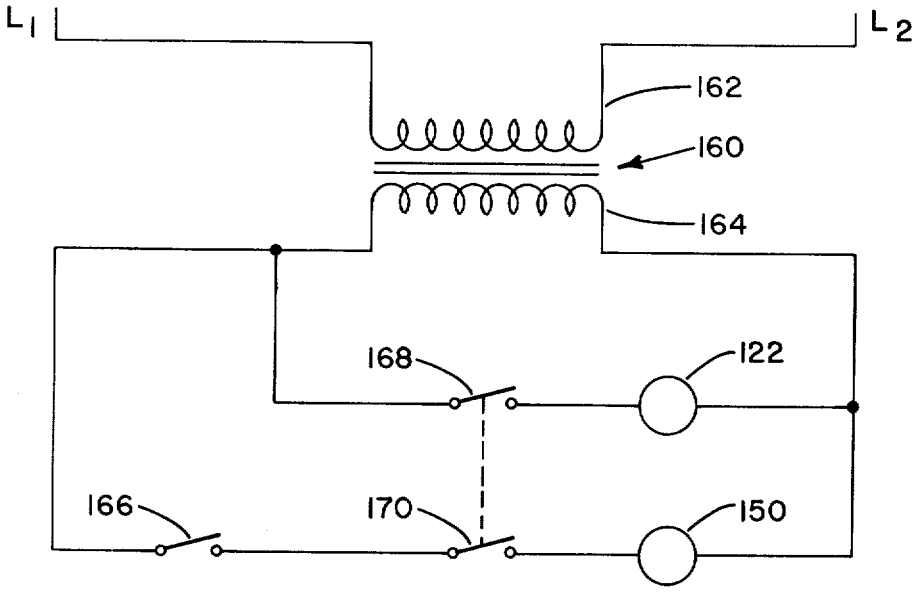
FIG. 4 is a schematic view of an electrical circuit suitable for use with the embodiment of FIG. 3.

The control system disclosed in FIGS. 3 and 4 includes a valve assembly 100 having a gas cock 102 and a pressure regulator assembly 104 similar to that employed in valve assembly 10 illustrated in FIG. 1. Gas entering valve assembly 100 passes through an inlet 106 and valve 108 of pressure regulator assembly 104. The gas or fluid is thereby delivered into a first chamber 110. A first valve member 112 is positioned within chamber 110. Valve 112 controls the passage of fluid from chamber 110 through opening 114 in wall 116 to second chamber 118. Valve 112 is operably connected to a bimetallic member 120. Bimetallic member 120 is operably associated with a resistance coil 122.

Valve assembly 100 further includes a push button valve 119. Valve 119 is manually depressible to the position illustrated in FIG. 3. Valve 119 includes a rod or shaft 121 having a groove 124 provided therein. A seating member 126 is provided at the end of shaft 121. A spring 128 is provided to return valve 119 to its normal raised position. Preferably, a finger or similar means 129 is connected to bimetallic element 120 of valve 112 to lock valve 119 in the position illustrated in FIG. 3 when it has been depressed. With valve 119 in its depressed state, passages 130 and 132 are in communication to thereby permit gas to flow from chamber 110 to filter 133.

Passages 132 and 134 communicate with a conduit 136 to deliver gas to a pilot burner (not shown) from filter 133. An adjustment screw or similar means 138 is provided to regulate the quantity of gas supplied to the pilot burner. A third passage 139 is provided in wall 116. Passage 139 communicates with conduit 140 to provide a combustible fluid to the pilot burner filter and thence ultimately to the pilot burner. In the position illustrated in FIG. 3, seating member 126 of valve 119 prevents the flow of fluid through passage 139 to conduit 140.

Valve assembly 100 further includes a second valve member 144. Valve 144 controls the flow of fluid from second chamber 118 to conduit 146. Conduit 146 supplies the combustible fluid to the main burner (not shown) of the combustion apparatus.

Valve 144 is operatively connected to a bimetallic member 148. The bimetallic member is operatively associated with a resistance coil 150. The energization of the resistance coil causes the bimetallic member to open valve 144 to permit flow of fluid to conduit 146.

Referring now to FIG. 4, there is shown a schematic view of an electrical circuit suitable for use as part of the control system including the valve assembly illustrated in FIG. 3.

The electrical circuit includes a transformer 160 having a primary winding 162 connected to a source of electrical power represented by lines L1 and L2, and a secondary winding 164. A normally open switch 166 responsive to the temperature of the space being conditioned is connected in series with winding 164. Switch 166 will close when the temperature of the space falls below a predetermined level.

The circuit further includes a normally open switch 168 connected in series with resistance coil 122 of valve 119. A second normally open switch 170 is connected in series with resistance coil 150 of valve 144. Switches 168 and 170 will close when the thermo-couple (similar to that illustrated in FIG. 1) associated with the pilot burner indicates that the pilot burner is operative. In the absence of a flame at the pilot burner, the switches will remain in their normally open position.

The operation of the control system of the embodiment illustrated in FIGS. 3 and 4 shall now be explained.

First, assume that the control system is completely inoperative; that is, no fluid is flowing to the combustion apparatus. Now assume that it is desired to have the combustion apparatus operable to supply heat as required. Gas cock 102 will be positioned to permit the flow of gas from inlet 106 to chamber 110 of valve assembly 100. Valve 119 will be in its normal raised position whereby seating member 126 prevents any flow of gas through passages 130 and 132.

To ignite the pilot burner, an operator must depress valve 119 so seat member 126 is moved to the position illustrated in FIG. 3 to permit communication between passages 130 and 132. When the valve is depressed, finger 129 on bimetallic member 120 engages groove 124 on shaft 121 to thereby lock the valve in its depressed position.

Fluid then flows from chamber 110 through passages 130 and 132, filter 133, passages 134 and 136, and thence to the pilot burner where it is ignited. After a predetermined time interval, for example seven seconds after the flame at the pilot burner has been present, the thermo-couple associated with switch 168 will close the switch to thereby energize resistance coil 122 of valve 112. Bimetallic element 120 will thus be heated to open valve 112 to permit the fluid to flow from first chamber 110 to second chamber 118. The opening of valve 112 will cause finger 129 attached to bimetallic member 120 to be withdrawn from groove 124 whereby spring 128 will return valve 119 to its normal raised position. However, fluid will continue to flow to the pilot burner via passage 139 and conduit 140. When thermostat 166 closes, resistance coil 150 associated with valve 144 will be energized to thereby heat bimetallic member 148 to open valve 144. Gas will then flow from chamber 118 to conduit 146 to the main burner.

If for any reason, the flame at the pilot burner were to be extinguished, the thermo-couple thereat would cool to open switches 168 and 170 to thereby deenergize resistance coils 122 and 150. The cooling of the resistance coils associated with bimetallic members 120 and 148 will cause valves 112 and 144 to close to thereby prevent any flow of fluid to both the pilot burner and main burner. The closing of valve member 112 prevents flow of fluid through passage 139, while the raising of valve 119 prevents flow of fluid through passages 130 and 132.

By providing series connected valves in both embodiments, both of which are placed into their closed position in the absence of a flame at the pilot burner, the control system of the present invention provides double safety control means in a single valve housing.

While preferred embodiments of the present invention have been described and illustrated, the invention should not be limited thereto, but may be otherwise embodied within the scope of the following claims.

I claim:

1. A fluid control system for use with combustion apparatus comprising:

a valve assembly having primary and secondary valves in series between an inlet and an outlet of said assembly;

a main burner in said combustion apparatus connected to said valve assembly outlet;

a pilot burner for said combustion apparatus positioned adjacent said main burner, said valve assembly having fluid flow conduits including first and second passages connected to said pilot burner;

means to sense a flame at the pilot burner and to generate a first control signal in the presence of a flame and a second control signal in the absence of a flame;

a third valve movable between first and second positions, when in said first position directing fluid through said first passage to said pilot burner; and when in said second position directing fluid through said second passage to said burner and preventing fluid from flowing through said first passage;

a first actuator for selectively operating said primary valve including means to open said valve to permit the passage of fluid from a first chamber to a second chamber of said assembly; said first fluid flow passage being in communication with said first chamber and said second fluid flow passage being in communication with said second chamber, with said pilot burner flame sensing means providing a selected one of said first and second control signals to said actuator to respectively open and close said primary valve, the closure of said primary valve in the absence of a flame at said pilot burner discontinuing flow of fluid to said second chamber and to said second flow passage;

said primary valve means including means to lock said third valve in said first position when said primary valve is in said closed position to direct fluid in said first chamber, to said pilot burner, through said first passage, the opening of said primary valve means in response to a sensed pilot burner flame releasing said locking means to place said third valve in its second position to close said first fluid flow passage and to open said second fluid flow passage to thereby communicate said pilot burner with said second chamber, the subsequent closure of said primary valve discontinuing flow of fluid into said second chamber and into said second fluid flow passage to said pilot burner; and a second actuator for selectively operating said secondary valve including means to open said valve in response to a demand for heating in a space served by said combustion apparatus to permit passage of fluid from said second chamber of said valve assembly to said main burner, said pilot burner sensing means providing said second control signal to said second actuator to maintain said secondary valve closed in the absence of a flame at said pilot burner.

2. A fluid control system in accordance with claim 1 wherein said first and second actuators respectively include a bimetallic member and an electrically energizable coil in contact therewith, said pilot burner flame sensing means providing said first control signal to selectively energize said coils to place said primary and secondary valves in their open positions.

* * * * *